United States Patent [19]

Kishida et al.

[11] Patent Number: 4,867,587

[45] Date of Patent: Sep. 19, 1989

[54] PRINTER FOR MONOCHROME AND COLOR PRINTING

[75] Inventors: Kozo Kishida; Hiromi Shishiuchi; Takao Mimura, all of Suwa, Japan

[73] Assignee: Seiko Epson Corporation, a Japanese Corporation, Tokyo, Japan

[21] Appl. No.: 45,005

[22] Filed: Apr. 30, 1987

[30] Foreign Application Priority Data

Apr. 30, 1986 [JP] Japan ..... 61-100169
May 20, 1986 [JP] Japan ..... 61-115629

[51] Int. Cl.[4] ..... B41J 35/14

[52] U.S. Cl. ..... 400/216.2; 400/208; 400/216.1

[58] Field of Search ..... 400/216.1, 216.2, 216.3, 400/216.4, 216.5, 227.2, 216, 215, 215.1, 215.2, 215.3, 215.4, 211, 212, 213, 213.1, 207, 208, 208.1

[56] References Cited

U.S. PATENT DOCUMENTS

| | | | |
|---|---|---|---|
| 4,425,046 | 1/1984 | Van Horne et al. | 400/212 X |
| 4,563,100 | 1/1986 | Hamamichi | 400/216.1 X |
| 4,586,837 | 5/1986 | Johnson et al. | 400/216.1 X |
| 4,611,938 | 9/1986 | Rettke et al. | 400/216 X |
| 4,693,619 | 9/1987 | Ishii et al. | 400/212 |

FOREIGN PATENT DOCUMENTS

| | | | |
|---|---|---|---|
| 174670 | 9/1985 | Japan | 400/227.2 |
| 183176 | 9/1985 | Japan | 400/227.2 |
| 72572 | 4/1986 | Japan | 400/212 |
| 2148796 | 6/1985 | United Kingdom | 400/215.2 |

*Primary Examiner*—David A. Wiecking
*Attorney, Agent, or Firm*—Blum Kaplan

[57] ABSTRACT

A printer for use with both monochrome and color ink ribbon cartridges has a cartridge holder which is rotatable to correctly position the ink ribbon of whichever cartridge is put in place in front of the print head. The cartridge holder and a transmission for driving it are mounted on a carriage which is movable in front of a platen. A driving motor for powering the transmission is placed on the carriage to convert the printer from monochrome so as to be able to use with either a monochrome or a color ink ribbon cartridge and a switch having two sets of contacts in a single circuit responds to the presence of a color ink ribbon cartridge to position the color ribbon in front of the printer at a color home position.

3 Claims, 14 Drawing Sheets

FIG. 11
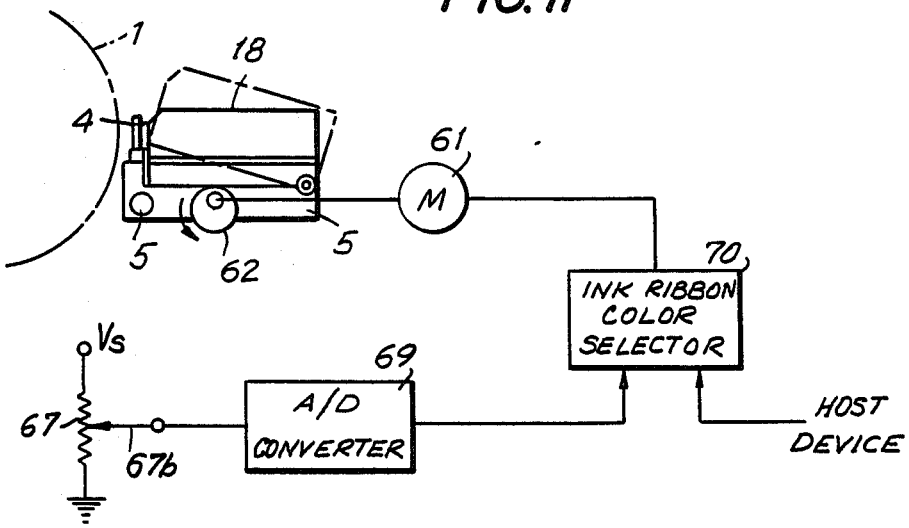
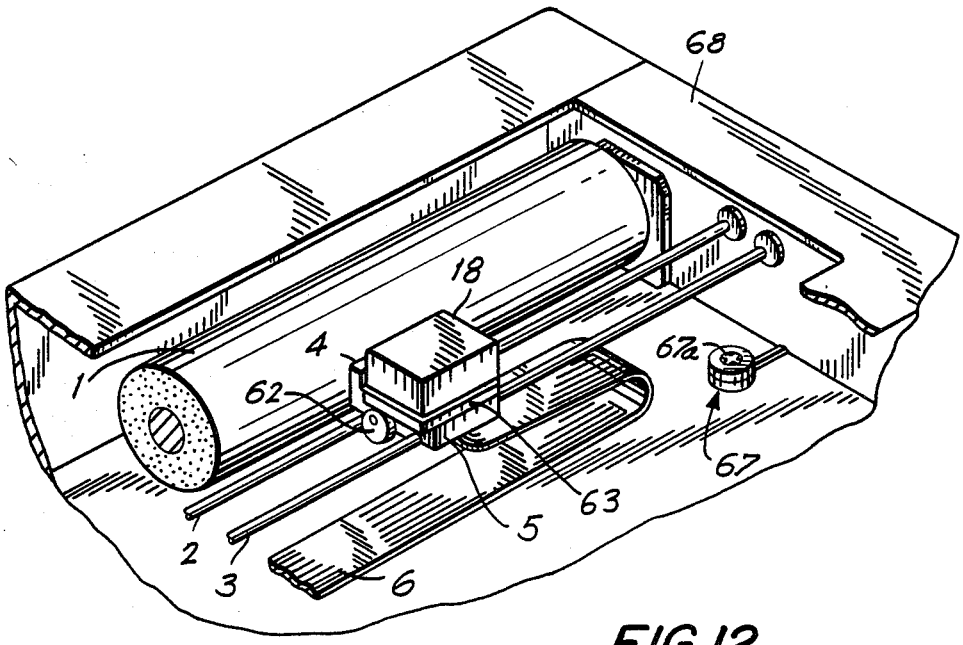
FIG. 12

PRINTER FOR MONOCHROME AND COLOR PRINTING

BACKGROUND OF THE INVENTION

The present invention relates to printers. More particularly, the invention relates to printers useful for both monochromatic and multi-color printing and to an ink ribbon cartridge holder for use in such printers.

In known printers, provision is made only for printing in one color. That is, monochromatic printers are not capable of driving a multi-color ink ribbon cartridge to permit use of the printer for multi-color printing. Also, known multi-color printers do not provide monochromatic printing even when a monochromatic ink ribbon cartridge is loaded. Thus, each printer has been specifically intended to be used for monochromatic or for color printing, and no printer has provided both.

The color selecting mechanism of a known multicolor printer is shown in FIG. 15. In the printer of FIG. 15, a color-selecting motor 81 is located under the printer's paper guide 88. A motor 81 drives a barrel cam 82 and power therefrom is transmitted to one end of an oscillating lever 83. The other end of lever 83 moves vertically a cartridge holder 84 which carries an ink ribbon cartridge 85 to position that portion of a color ribbon (not shown) which has ink of a desired color in front of platen 87 for printing. Motor 81, together with other parts, is secured to the mechanism and neither the motor nor the driving unit, which includes the motor and its peripherals, can be removed easily by the user.

Further, as mentioned above, a monochromatic printer of known type cannot be easily changed into a multi-color printer. Generally, therefore, if the purchaser of a monochrome printer comes to need multicolor printing, he must buy still another printer.

Also, in known color printers accurate matching of the upper and the lower positions of the ink ribbon cartridge is performed by fine adjustment of an adjusting member which is attached to the print head carriage. Since the print head carriage is subject to vibration and to external shock, any set value is subject to change as the machine is used and is, therefore, unstable, with the result that the ink ribbon cartridge will often be incorrectly positioned.

SUMMARY OF THE INVENTION

The foregoing problems are solved in the present invention by a printer having a carriage which is conventionally movable in front of a platen. The carriage carries a print head which can be conventionally actuated to effect printing on paper which is held in front of the platen, and also carries a holder for a ribbon cartridge. The cartridge holder can interchangeably receive a monochrome ribbon cartridge and a color ribbon cartridge. A cartridge-shift drive motor is removably mounted on the carriage, and, when present on the carriage along with a color ribbon cartridge, provides motive power for moving the cartridge or a cartridge holder to position the color ink ribbon between the print head and the platen for printing a particular color.

In one embodiment, a cartridge holder is pivotally mounted on the carriage so that a selected portion of the ribbon, if a color ribbon cartridge is present, can be positioned for printing by tilting the cartridge. Sensing switches may be provided which identify the type of cartridge which is mounted on the carriage and establish the "home" position of a color cartridge when such is used. According to one aspect of the invention, the two switches are combined into a single detector.

In another embodiment, the ink ribbon cartridge is pivotally mounted on the carriage and the printer can be changed from a monochrome printer to one which uses either a monochrome ink ribbon cartridge or a color ink ribbon cartridge by positioning a drive unit on the carriage. When a monochrome ink ribbon cartridge is used, it is rotated on the pivots into position against a stop by a resilient spring so that the ink ribbon is located in front of the print head. When a color ink ribbon cartridge is used, the same spring urges the cartridge into engagement with the drive unit so that the drive unit can position a selected color band of the ink ribbon in front of the print head. The monochrome cartridge and the color cartridge are dimensioned differently so that the monochrome cartridge does not come into engagement with the motor drive unit and so that the color cartridge does not engage the stop. A mechanical stop on a cam in the drive unit can define the home position.

According to another feature of the invention, the initial position of the color cartridge can be predetermined by means of an adjustable resistor.

An object of the present invention is to provide an improved printer in which color or monochrome printing can be easily selected at any time.

A further object of the invention is to provide differing structural features in one of a monochromatic ink ribbon cartridge and a multi-color ink ribbon cartridge to permit detection of the presence of one or the other in a printer.

Still another object of the invention is to provide means by which detection of the home position of the ink ribbon cartridge is accurately performed.

A still further object of the invention is to provide means by which the fine adjustment of the positions of an ink ribbon cartridge in a printer is securely performed.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 11 is a partly pictorial and partly schematic diagram illustrating the manner of positioning an ink ribbon cartridge in accordance with the present invention;

FIG. 12 is a perspective view of a printer embodying the apparatus of FIG. 11;

FIG. 19(*b*) is a cross-sectional view of the mounting of FIG. 19(*a*);

DETAILED DESCRIPTION OF THE INVENTION

Figure 1:
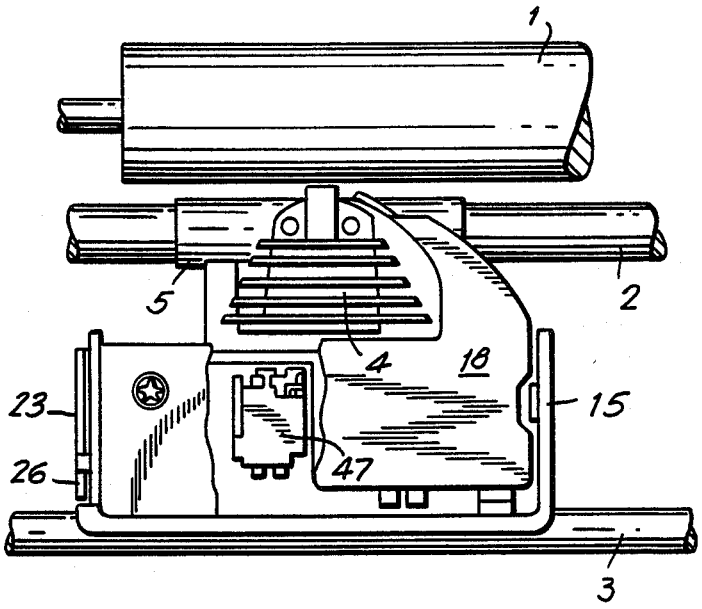
FIG. 1 is a plan view of a carriage for an ink cartridge in a printer fabricated in accordance with the teachings of the present invention.

FIG. 1 is a plan view in partial cross-section of a printer carriage 5 fabricated in accordance with the teachings of the present invention. Carriage 5 carries a print head 4 back and forth on a pair of guide shafts 2 and 3 in front of and parallel to a platen 1 for printing on paper which is held thereon (not shown). Carriage 5 also carries a ribbon type detector 47.

Figure 2:
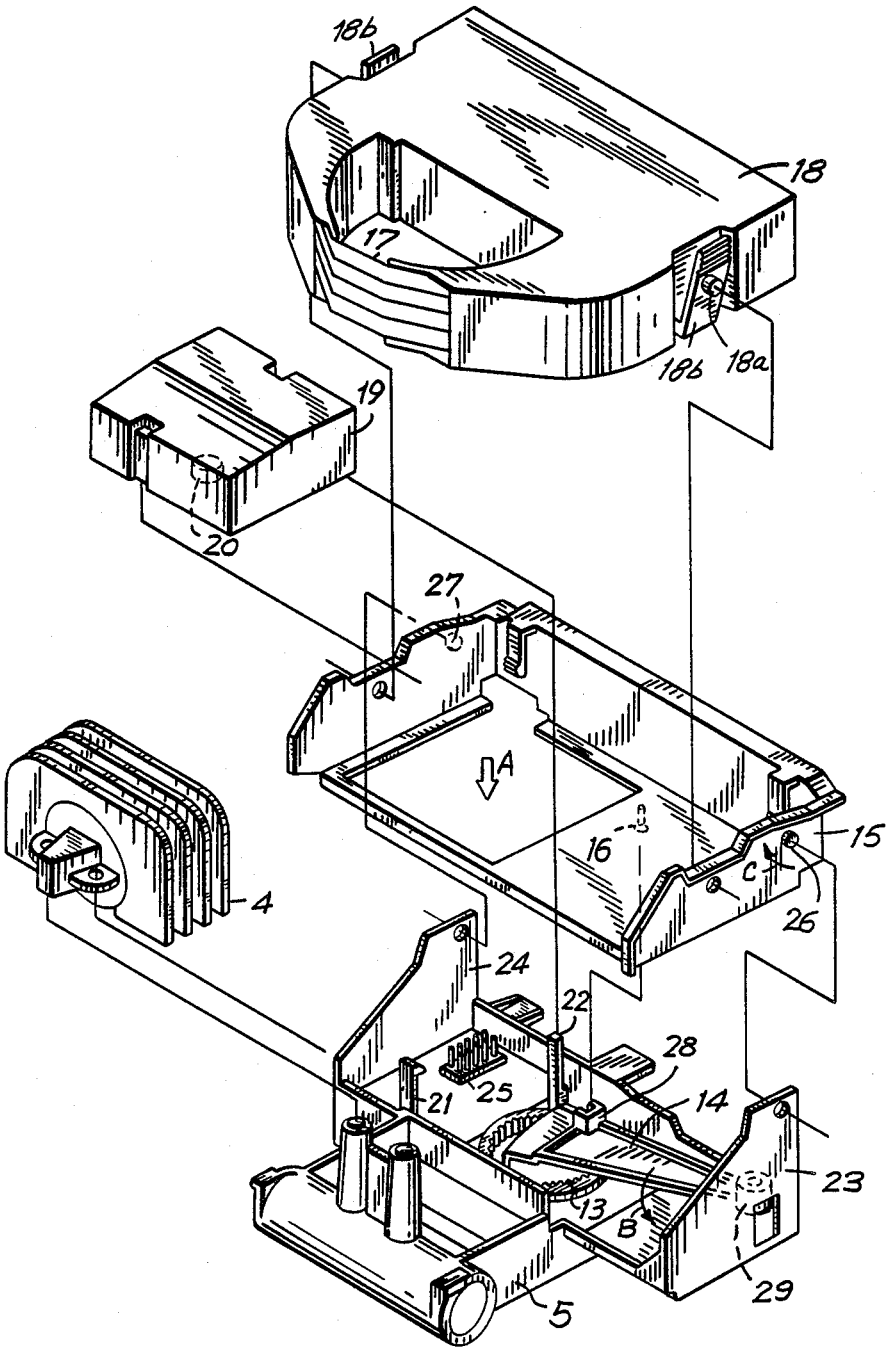
FIG. 2 is an exploded view of the ink cartridge and carriage of the assembly of FIG. 1.
Figure 3:
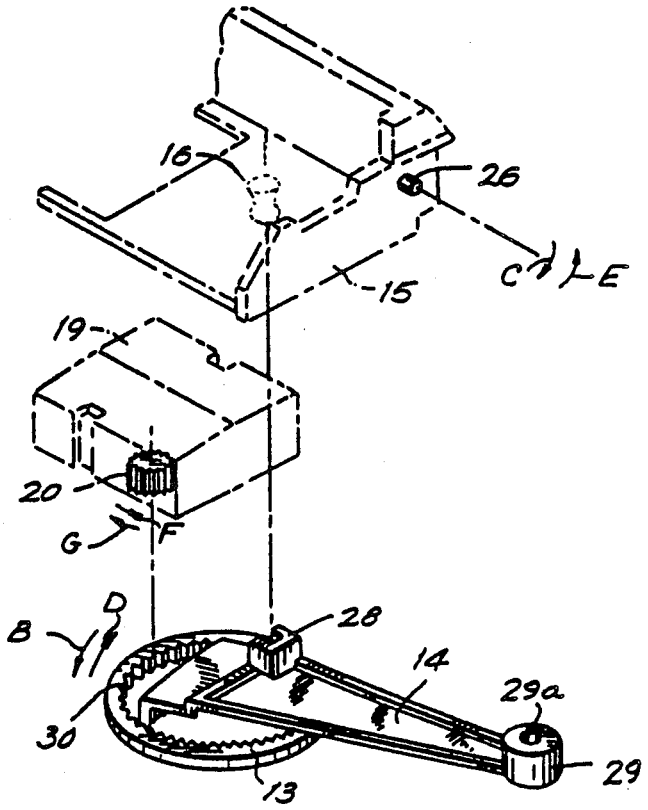
FIG. 3 is an exploded view in partial phantom, illustrating the mechanism for rotating the ink ribbon cartridge of FIGS. 1 and 2.

As can be seen in FIGS. 2 and 3, print head 4 is supported on and secured to carriage 5. Carriage 5 also supports a transmission gear 13 and an oscillatable lever 14 on separate axes and in engagement with each other. Space is provided between side walls 23 and 24 of carriage 5 for support of an ink ribbon cartridge holder 15, into which an ink ribbon cartridge 18 can be readily inserted. A vertical arm 16, on the underside of cartridge holder 15 is movably received in, and can receive motion from, a slotted connector portion 28 of oscillatable lever 14.

Carriage 5 is also provided with a pair of oppositely-facing upright claws 21 and 22 for removably securing a color-selecting motor unit 19 in a predetermined position on carriage 5, and engaging a connector 25 for making electrical connection between motor unit 19 and the ink ribbon color selection control circuit of FIG. 11. When multi-color printing is to be done, motor unit 19 is inserted in carriage 5, being pushed down in the direction of arrow A so as to be held to carriage 5 by hooks 21 and 22. When motor unit 19 has been emplaced, a drive gear 20, which protrudes downward from motor unit 19, meshes with inner teeth 30 of transmission gear 13, enabling power from motor unit 19 to be transmitted to ink ribbon cartridge holder 15. Also, when motor unit 19 is in place, it engages connector 25 and is connected to the electric circuit of the printer.

Figure 4:
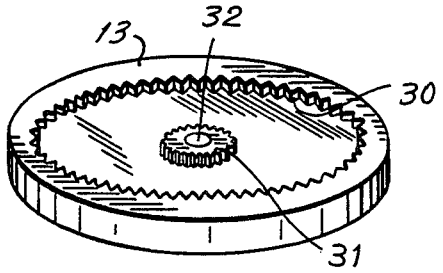
FIG. 4 is a perspective view of the transmission gear of FIGS. 2 and 3.

As detailed in FIG. 4, transmission gear 13 has an axially-extending, peripheral rim, which carries a set of inward-projecting teeth 30, and a raised central portion which has a set of outward-projecting teeth 31. Both sets of teeth are centered around a gear shaft hole 32. Both sets of teeth are formed on the one gear body.

As depicted in FIGS. 3–6, the fulcrum 29 of transmission lever 14 is oscillatable around a pivot 5*a* on carriage 5, being positioned so that its inner teeth 33 engage teeth 31 of transmission gear 13.

When monochrome printing is selected, motor unit 19 is not mounted in the carriage and rotation of the transmission gear 30 is limited by a bridge or the like (not shown) so that oscillatable lever 14 can move no further than a predetermined position.

Figure 5:
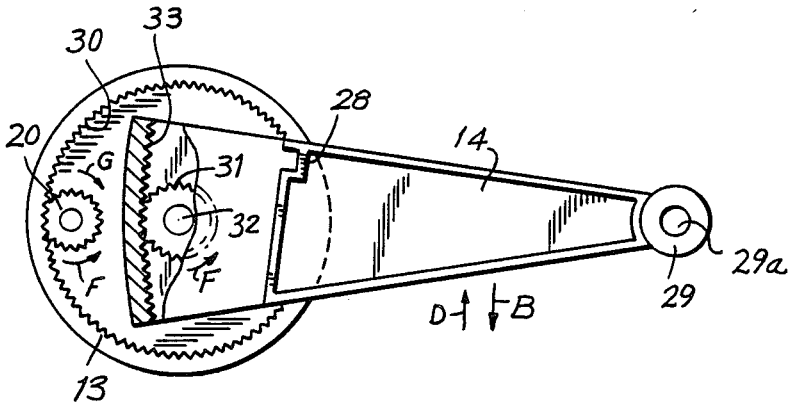
FIG. 5 is a plan view depicting the manner of operation of the oscillatable lever of FIGS. 2 and 3.

The manner of switching ink ribbon 17 (FIG. 2) between ink colors is described with reference to FIG. 5. When gear 20 of motor unit 19 rotates in the direction of arrow F, its motion is transmitted to inner teeth 30 of transmission gear 13 and thence to teeth 31 of transmission gear 13, which rotate in direction F. From teeth 31, power is transmitted to inner teeth 33 of rotatable lever 14, causing oscillatable lever 14 to rotate about pivot shaft 5*a* in the direction of arrow B. Vertical arm 16 on cartridge holder 15 is engaged in slotted connecting portion 28 (FIG. 2) of oscillatable lever 14 and is driven thereby to cause cartridge holder 15 to rotate on pivots 26 and 27 in the direction shown by arrow C, lifting the ink ribbon in front of the print head. Shifting thus between the color bands of ink ribbon 17 is continued by rotating gear 20 of motor unit 19 until the desired color band is in front of the printing head 4. At this time, rotation of gear 20 of motor unit 19 is stopped. Now, when print head 4 is driven, the selected color will be printed on paper which is held in front of the print head on platen 8.

To lower the ink ribbon, gear 20 of motor 19 rotates in the direction of arrow G, oscillatable lever 14 rotates around the fulcrum 29 in the direction of arrow D. Now, cartridge holder 15 rotates around pivot projections 26 and 27 in the direction of arrow E and cartridge holder 15 rotates in the opposite direction from that when gear 20 is rotated in the direction of arrow F.

In accordance with the present invention, the ink ribbon color is selected by using the reciprocal rotation of the motor which moves the oscillatable lever 14, as described above, in the direction of arrow B or of arrow D (FIG. 3) and, consequently, by rotating ink ribbon cartridge holder 15 in the direction of arrow C or of arrow E, respectively. Moreover, the invention provides, in one embodiment, that the mounting of motor unit 19 on the carriage results in the arbitrary selection of multi-color printing. Thus, either monochromatic and multi-color ink ribbon cartridge can be used in the same printer.

According to another feature of the invention, the addition of a detector or the like to a multi-color printer enables use of both a monochrome ink ribbon cartridge and the multi-color ink ribbon cartridge therein. Provision is made for detection of the kind of cartridge as well as for determining the home position of the cartridge. To this end, the apparatus of the invention is provided with a mechanism for detecting which kind of ink ribbon cartridge is present and for establishing the home position of the cartridge is now explained with reference to FIGS. 6 to 9.

Figure 6:
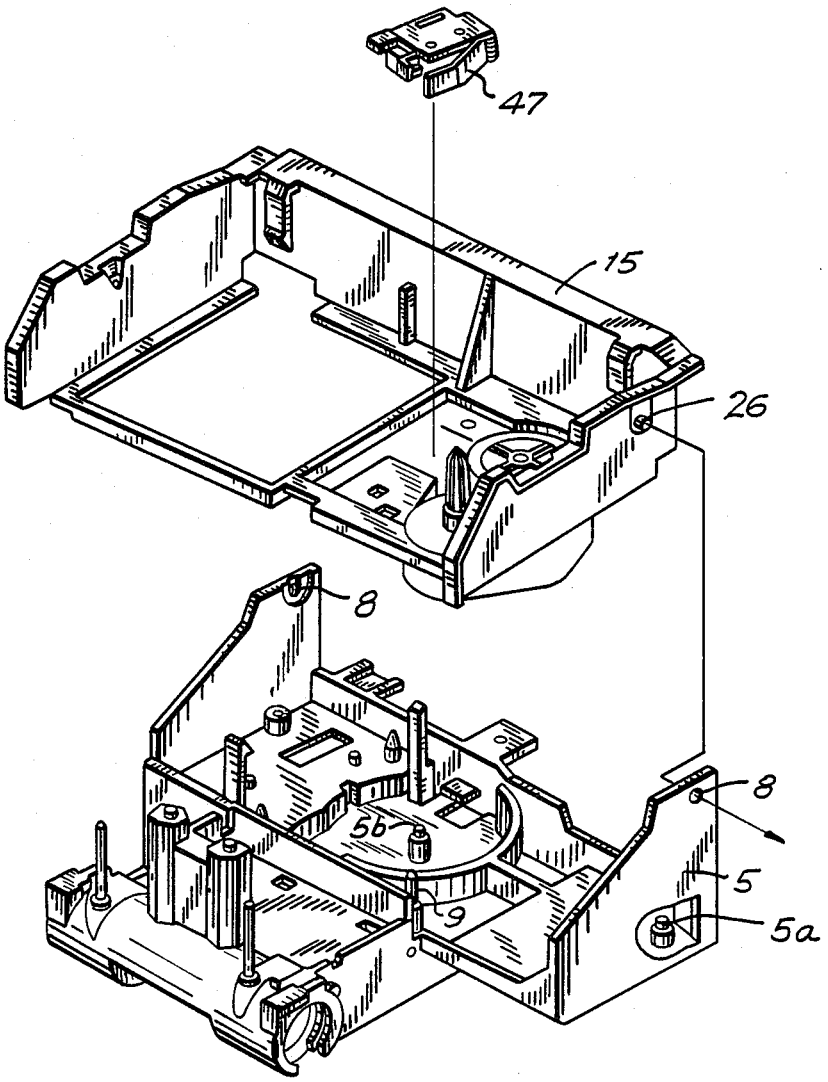
FIG. 6 is an exploded view of the cartridge carrier showing details of an ink ribbon cartridge holder and a ribbon type detector in accordance with the teachings of the invention.

As depicted in FIG. 6, holes 8 are provided, on both sides of carriage 5, for receiving the laterally-projecting support pivots 26 of cartridge holder 15, about which the cartridge holder is oscillatable. Further, carriage 5 is provided with a vertically projecting member 9 for use in locating the color home position of cartridge holder 15.

Figure 7:
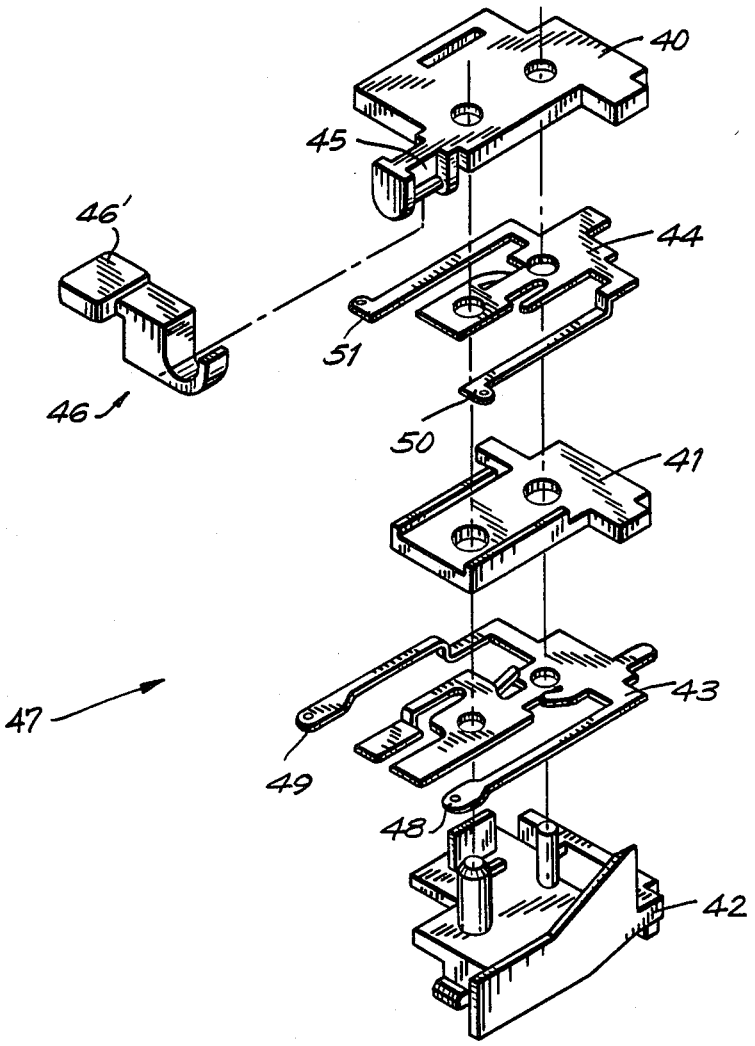
FIG. 7 is an exploded view showing details of the ribbon type detector of the invention.
Figure 8A:
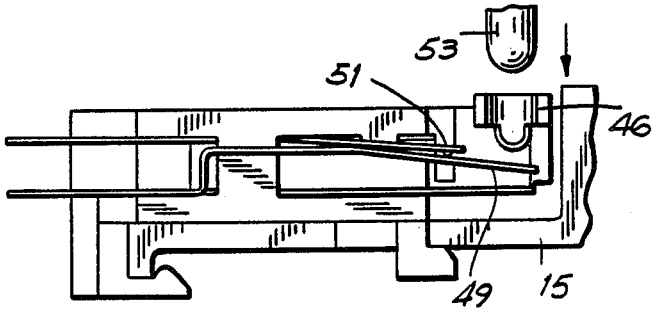
FIGS. 8(*a*), 8(*b*), and 8(*c*) are side, plan, and side views, which depict operation of the ribbon type detector of the invention.
Figure 8B:
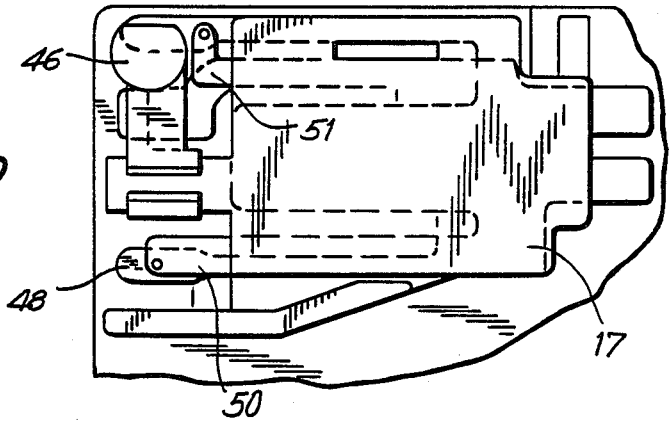
Figure 8C:
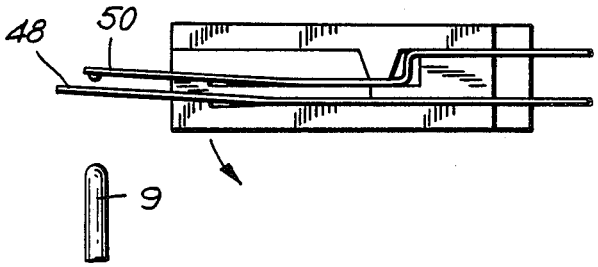
Figure 9A:
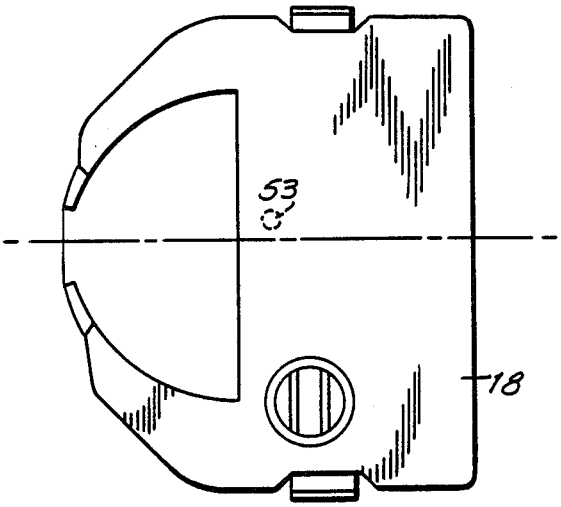
FIGS. 9(*a*) and 9(*b*) are plan and side views, respectively, of an ink ribbon cartridge fabricated according to the present invention.
Figure 9B:
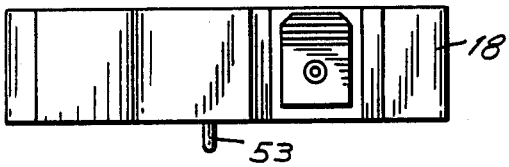

In the exploded view of FIG. 7, cartridge detector 47 is shown as having three parallel insulating members 40, 41, and 42, between which two conducting contact plates 43 and 44 are secured. An actuator 46 is rotatably fitted on portion 45 of insulating member 40, being supported from beneath, for example, by the surface of cartridge holder 15 on which detector 47 is seated. Contact plates 43, 44 respectively have contact portions 48, 49 and 50, 51. Contacts 48 and 50 are normally open, and contacts 49 and 51 are normally closed, thus forming a single-circuit switch having two sets of contacts. Detector 47 is held to cartridge holder 15 by claws extending from the lower portion of insulating member 42.

Generally speaking, a color typing ribbon is divided longitudinally into four colors: B (black), M (magenta), C (cyan) and Y (yellow) and has a width of about 1 inch, e.g. about 25 mm. On the other hand, a monochrome ink ribbon is only about 13 mm wide. Since the thickness of a color ink ribbon cartridge is different than that of a monochrome ink cartridge, the position at which the monochrome cartridge prints correctly will not be appropriate for a color cartridge. When these ribbon cartridges are used on the same printer, therefore, it is necessary to establish the home position of a color ribbon when it is loaded so that printing will always correctly use the center portion thereof.

The foregoing problem is solved in the present invention by providing for initial positioning of the multicolor ink ribbon and the monochromatic ink ribbon at different levels. To this end, the type of ribbon, e.g. multi-color or monochromatic, is detected when the cartridge is loaded. For this purpose, the bottom of multicolor ink ribbon cartridge 18 (FIG. 9) is provided with a pin or projection 53 for pushing down on tab 46' of actuator 46 in detector 47 when the multicolor cartridge is loaded on cartridge holder 15. The lower side of actuator tab 46' then engages and pushes down on the extended portion 49 of contact plate 43, moving it away from contact 51 and causing the normally closed switch contacts 49 and 51 to open. In other words, when a multi-color ink ribbon cartridge has been loaded, switch contacts 49 and 51 are open; when a monochromatic ink ribbon cartridge has been loaded, switch contacts 49 and 51 are closed.

Contacts 48 and 50, which control color home positioning, are normally open. When power from motor 19 (on carriage 5) is transmitted, at the outset, to ink ribbon cartridge holder 15, the outer portion of ink ribbon cartridge holder 15 moves lower, and an upward-extending color-positioning projection or post 9 on carriage 5 (FIG. 6) presses contact projection 48, closing contacts 48 and 50. In response to a contact closing signal, generated thereby, driving of oscillatable arm 14 by motor 19 is slowed and stopped. The position of ink ribbon cartridge holder 15 at this time is known as the "color home position".

The operational sequence of cartridge holder 15 in ribbon detection and color home positioning is described below.

Figure 10:
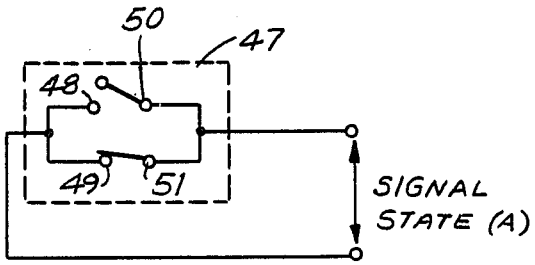
FIG. 10 is a schematic circuit diagram of the ribbon type detector of the present invention.

First, cartridge holder 15 is moved upward, opening contacts 48 and 50. At this time, the condition of the switches in detector 47, shown as signal state (A) in FIG. 10, is read. If the signal state (A) indicates contacts "closed", the loaded ribbon is identified as monochrome and cartridge holder 15 is moved to a position such that the printing head is centered to strike the center of the monochrome ribbon and stays at that position. If signal state (A) indicates an "open" contact, the loaded ribbon is identified as multi-color. Cartridge holder 15 is then moved downward until contacts 48 and 50 close, being then positioned so that the printing head strikes the center of the total width of the multi-color ink ribbon. Subsequent movements of the cartridge holder for printing different colors now are all related to this "color home position".

The foregoing method of the invention for adjusting for the optimum position of the cartridge, relative to the print head, is explained with reference to FIGS. 11 and 12. In FIGS. 11 and 12, carriage 5 positions a print head 4, in response to a print signal which is delivered from a host device (not shown) for printing information on paper which is supported on platen 1 in front of ink ribbon cartridge 18. Carriage 5 has an ink ribbon cartridge holder 63 which is coupled to a power transmission which includes an eccentric cam 62; turned by a motor 61, such as a stepping motor. When so turned, cartridge holder 63 pivots cartridge 18, moving the surface of the ink ribbon relative to printing head 4.

As depicted in FIG. 12, the body 68 of the printer supports a semi-fixed resistor 67 in a location which can be reached by an appropriate instrument or tool which is inserted easily from the outside. Semi-fixed resistor 67 is receives a reference voltage $V_s$ (FIG. 11) and supplies, at tap terminal **67*b*, a voltage which is proportional to the amount of rotation of an adjusting knob 67*a*. The voltage from terminal 67*b* is fed to an analog-digital converter 69 where it is converted into a digital signal for use in controlling the initial elevation of the ink ribbon relative to print head 4. To this end, the digital signal is fed to an ink ribbon color-selecting circuit 70. Color selecting circuit subsequently responds to printing color designating signals from the external host device, or from an operational board of the printer (not shown) to actuate motor 61 and further set the elevation of the ink ribbon relative to printing head 4** to select a desired color for printing.

In the illustrated embodiment, when the power switch of the printer is turned on, ink ribbon color-selecting circuit 70 is actuated so as to rotate drive motor 61 by an amount corresponding to the signal delivered from analog-digital converter 69, i.e., the amount which is preset into variable resistor 67, thereby adjusting the initial position of ink ribbon cartridge 18. Then, when a print color selecting signal is output from the host device, ink ribbon color-selecting circuit 70 responds appropriately, actuating motor 61 to elevate or depress the print head side of ink ribbon cartridge 18 until the ribbon section having the desired color faces print head 4. Cartridge 18 is maintained at that position until another color designating signal is received.

Now, when the host device outputs print data and timing signals, print head carriage 5 moves along the platen in the printing direction, and print head 4 prints on the paper character patterns corresponding to the data, using the selected color section of the ribbon.

When, after lengthy use, the selection of printed colors becomes facilty, or when the position of the ink ribbon cartridge is to be adjusted at the factory, the adjustment is made by first operating the host device or the operating board of the printer to put out a print color designating signal. Holding a gauge, such as a ruler, at ink ribbon cartridge 18, the relative positions of the ink ribbon and of print head 4 are observed while terminal adjusting knob 67*a* of semi-fixed resistor 67 is turned by a screwdriver or other suitable tool. Sliding terminal 67*b* of variable resistor 67 outputs a voltage whose value is proportional to the degree of rotation of adjusting knob 67*a* and which is converted into a digital signal value by analog-digital converter 69 for supply to ink ribbon color-selecting circuit 70. Ink ribbon color selecting circuit 70 outputs a signal corresponding to the digital-converted value to motor 61 and ink ribbon cartridge holder 63 moves vertically relative to print head 4. By slow rotation of adjusting knob 67*a*, the desired color section of the ink ribbon is brought opposite print head 4. The adjustment is now complete, and the gauge is removed. After adjustment, the amount of the adjustment is stored as the resistance of the semi-fixed resistor 67, regardless of whether the power switch of the printer is turned on or off.

Figure 13:
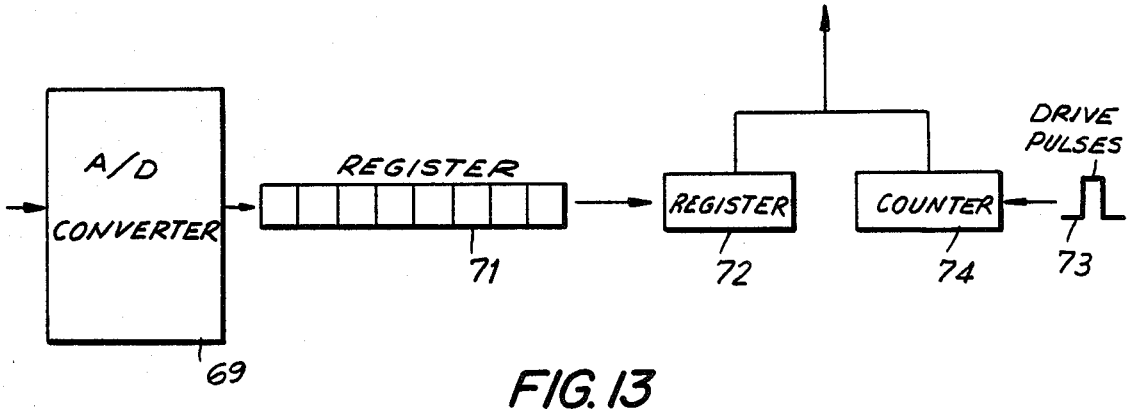
FIG. 13 is a block diagram illustrating the flow of signals in the system of FIG. 12.

FIG. 13 illustrates a circuit for converting the resistance of variable resistor 67 from analog to digital form in the printer of FIGS. 11 and 12. An analog/digital (A/D) converter 69 outputs the converted value in digital form into a register 71. When, for instance, register 71 is an 8-bit register, the resistance of variable resistor 67 is converted by A/D converter 69 into a value of from 0 to 255, and is then fed into register 71. The value stored in register 71 is subsequently divided by a predetermined number n and the resulting number of pulses, corresponding to the quotient, is set into pulse number setting register 72. If, for example, the resistance is divided by 10 and the value set into and stored in the register 71 is between 0 and 19, the value 1 is set into register 72. When the value is 20 to 39, the value 2 is set into register 72.

The drive pulses 73 which drive step motor 61 are input to a counter 74. Every time that a pulse is input, the values of counter 73 and of register 72 are compared, and, when the values coincide, an output pulse is fed into driving motor 61 to cause the driving motor to rotate.

Figure 14:
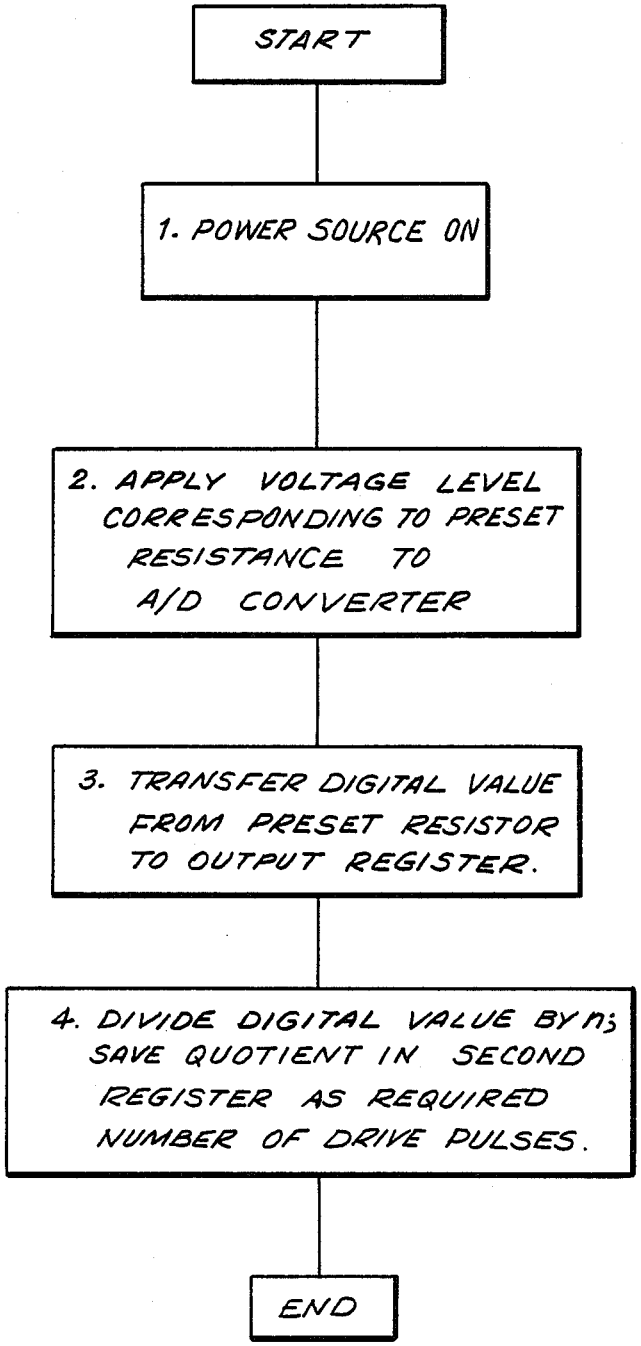
FIG. 14 is a flow chart illustrating the setting of pulses into the register of the invention.
Figure 15:
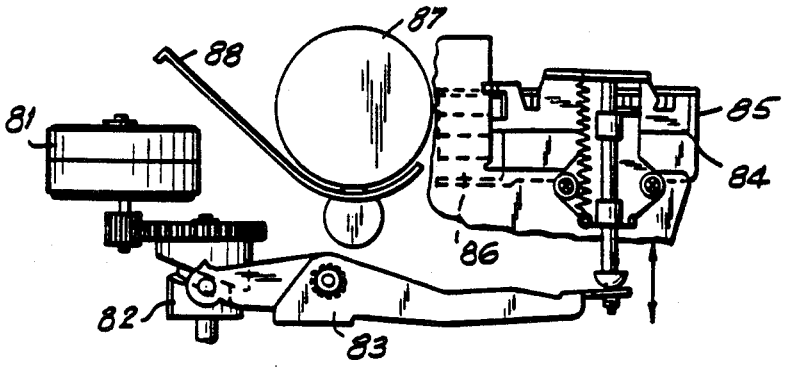
FIG. 15 PRIOR ART
FIG. 15 is an elevational view illustrating portions of a known color selecting mechanism.

A flow chart illustrating the setting of the number of pulses into register 72 after the power is turned on is shown in FIG. 14.

When the printer power is turned on (step 1), the voltage corresponding to the preset resistance of variable resistor 67 is fed into A/D converter 69 (step 2). The digital value corresponding to the resistance is then output into output register 71 (step 3). Finally, the value set into register 71 is divided by the predetermined number n and the required number of driving pulses is calculated and set into register 72.

This arrangement is advantageous in that, by presetting the value of the reference resistance into the A/D converter, the input resistance can be compared with the reference resistance and a negative number of pulses (that is, the requisite number of pulses to effect reverse rotation of the driving member 61) set into register 72. In this case, first the sign (positive or negative) of the value preset in register 72 is detected and then, depending upon the result, the direction of rotation of driving member 61 is determined.

As described above, a printer fabricated in accordance with the teachings of the invention has the following advantageous effects.

(a) A printer can easily be turned from a monochrome printer into a multi-color printer simply by attaching a motor unit, an arrangement which provides a great economic advantage for the user. Moreover, since the motor unit need only be pushed into place without use of an instrument or tool, the installation can easily be performed by the user.

(b) The same printer can thus be used for both monochrome and multi-color printing.

(c) Since the motor unit is mounted on the print head carriage, the conventional external dimensions of a monochrome printer need not be exceeded and thus a compact multi-color printer is obtained.

(d) The two-contact, one-circuit detector switch which is provided in the ink ribbon cartridge holder, both detects whether a monochrome or a multi-color ink ribbon cartridge is present and effects the "home" positioning of the cartridge, an economical arrangement. Furthermore, the detector is compact and the electrical circuit is simple, all of which contributes to reducing the size of the printer as a whole. Further, due to the electrical detection of the color home position, accurate positioning of the ink ribbon cartridge is provided.

(e) By mounting the adjustable resistor in the housing of the printer body, the signals therefrom can be output readily into the ink ribbon color selecting circuit and, at the same time, the adjusting member can be mounted at a position where the adjusting operation can be done easily. Therefore, a problem inherent in known color ribbon adjusting structures is eliminated, since the adjusting member is not mounted on the carriage and is therefore not subject to vibration and external shocks which would otherwise result in frequent readjustment.

Figure 16:
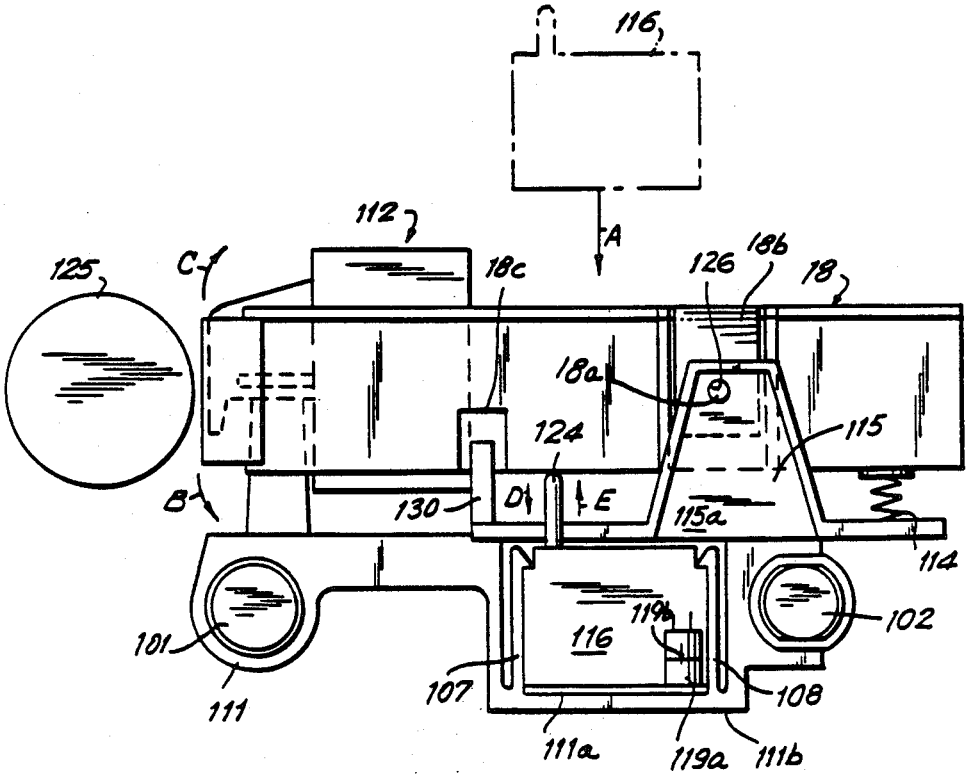
FIG. 16 is a cross-sectional elevational view of another embodiment of the present invention.

Reference is now made to FIGS. 16–21 where another embodiment of the present invention is depicted. As shown in FIG. 16, a print head carriage 111 is mounted on parallel shafts 101, 102 for sliding movement back and forth in front of a cylindrical platen 125. A cartridge base 115 in which multi-color ink ribbon cartridge 18 (see FIG. 2) is supported, is mounted on carriage 111. The bottom surface of the rear portion of cartridge 18 presses against a coil spring 114 on carriage 111 which urges the cartridge in a counter-clockwise direction. A removable motor unit 116 is supported in a recess 111*a* of carriage 111 and is connected by a self-contained connector 119*b* to a mating connector 119*a* mounted in recess 111*a* to receive power from the electrical circuit. Motor 116 is releasably held in place by laterally displaceable hooks 107, 108. When the printer is to be used for multi-color printing, motor unit 116 is pushed downward from above into recess 111*a* in the direction of arrow H when no cartridge is in place. When motor unit 116 reaches the intended position, it is held by hooks 107, 108 and the parts of connector 119 are united to complete the electrical circuit. Cartridge base 115 and carriage 111 may be formed as one body.

Figure 17:
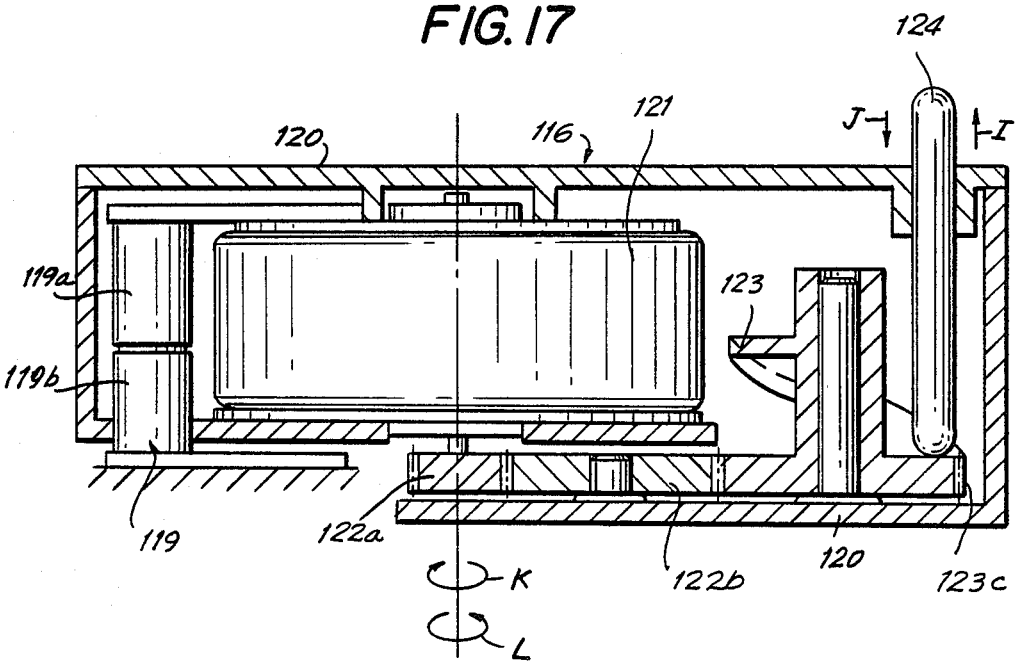
FIG. 17 is a cross-sectional plan view of the motor unit of the embodiment of FIG. 16.

As depicted in FIG. 17, motor unit 116 includes a housing 120 supporting an electric motor 121 which provides the driving power for color selection. A motor drive gear 122*a* is supported on the motor shaft. An intermediate drive gear 122*b* and a cam drive gear 123*c* integrally formed on a spiral cam 123 are supported on housing 120. Spiral cam 123, as it turns, raises or lowers cam follower rod 124 in directions I and J, respectively.

Multi-color ink ribbon cartridge 18, as detailed in FIG. 2, contains a multi-color ribbon 17 and has, mounted on the left and right sides thereof, in recesses, a pair of resilient members 18*b*. A laterally projecting axle pin 18*a* is mounted on each resilient member 18*b* for engaging a respective hole 126 in each lateral support member 115*a* on base 115 (only one of two such supports is shown). The lower surface of multi-color ribbon cartridge 18 (FIG. 16) is provided with a downward opening groove 18*c* which provides clearance for a vertical positioning member 130 on cartridge base 115. Member 130 positions a monochrome ink ribbon cartridge which does not have such a groove when the printer is to be used for monochrome printing, (see FIG. 20).

When a multi-color ribbon cartridge 18 is to be used, drive motor 116 being in place in carriage 111, the cartridge is emplaced in cartridge base 115 by compressing resilient support members 18*b* so that projecting axle pins 18*a* can be inserted in the holes in upward-projecting base side members 115*a*. Cartridge 18 is now rotatably suspended in base 115 and is biased counter-clockwise, in the direction of arrow M (FIG. 16), by biasing spring 114. At the same time, the lower surface of cartridge 18 contacts cam follower rod 124, which extends upward from motor unit 116, and is positioned by it. Now, when color-selection motor 121 is rotated in the direction of arrow K (FIG. 17), cam follower rod 24 moves along the profile 123*b* of cam 123 and is raised in the direction of arrow I, causing multi-color ink ribbon cartridge 18 to rotate in the direction of arrow N raising the multi-color ribbon relative to print head 112. Rotation of the motor is stopped when the desired band of multi-color ink ribbon 17 (FIG. 2) is positioned in front of print head 112 for printing. When print head 112 is driven, the desired color will be printed on a recording medium (not shown) which is held between the print head and platen 125.

To reach other color ribbon bands in the ribbon, motor 121 can be turned in the direction of arrow G so that cam follower rod 124 moves downward in the direction of arrow J (FIG. 17), rotating multi-color ink ribbon cartridge 18 in the direction of arrow M.

Figure 18:
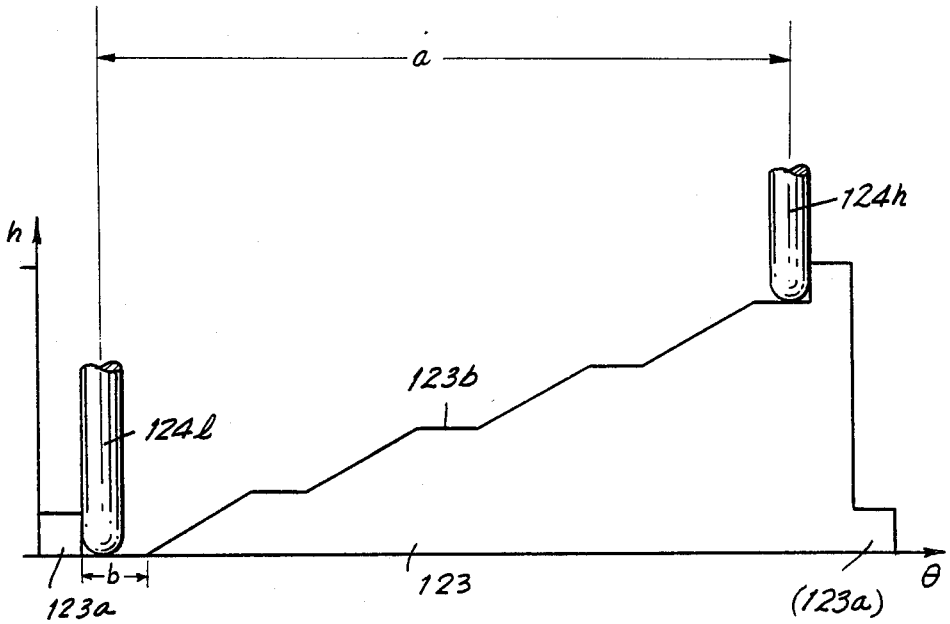
FIG. 18 is a profile of the cam of the motor unit of FIG. 17.

The home position of multi-color ink ribbon cartridge 18 is established as follows. As shown in FIG. 18, cam 123 has a profile 123*b*. If the motor is rotated continuously in the direction of arrow L (FIG. 17), cam follower rod 124 reaches an end positioning member 123*a* of cam 23, and the motor steps out. After detecting the step-out of the motor by the variety of the driving waveform or after driving at more pulse amount than that required for moving the cam follower rod 124 in the maximum range (a), the motor is stopped and then, the cam follower rod 124 is stopped in the home position (b). This is the home position from which multi-color ink ribbon cartridge 13 can be rotated to select any of the colors of the multi-color ink ribbon. Thus, in the embodiment of FIG. 16, a home position which accurately positions the cartridge is provided without the need for any particular electrical device to detect and signal it.

Figure 19A:
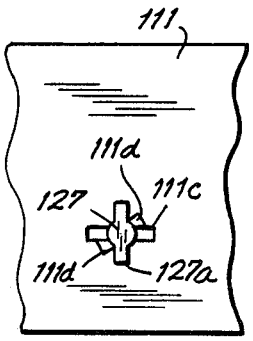
FIG. 19(*a*) is a bottom elevational view of an alternative mounting for the motor unit of FIG. 17.
Figure 19B:
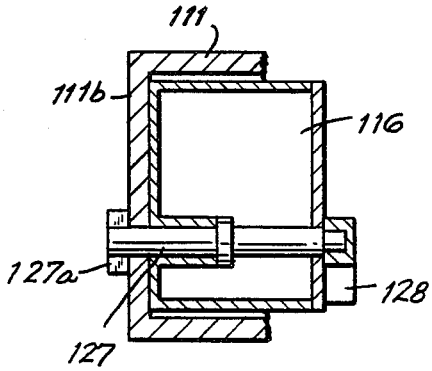

FIGS. 19*a* and 19*b* illustrate an alternative arrangement for securing motor unit 116 in carriage 111. In this embodiment, bottom wall 111*b* (see also FIG. 16) of carriage 111, in registration with recess 111*a*, is provided with a slotted opening 111*c* which receives a lock pin 127. Lock pin 127 is mounted in and passes through motor unit 116 and has, at its one end, a laterally extending lock portion 127*a* which is dimensioned to pass through slot 111*a* when motor 116 is being seated. Lock pin 127 has, at its other end, a lock lever 128 which is positioned on the exposed surface of motor 116 for manual rotation of the lock pin 127 and lock portion 127*a* to bring lock portion 127*a* out of registration with slot 111*a* to retain motor unit 116 in position. Slot 111*c* is defined by sloping surfaces 111*c* which extend from both surfaces of bottom wall 111*b* to permit engaging portion 127*a* to rotate smoothly into position on bottom wall 111*b*.

Figure 20:
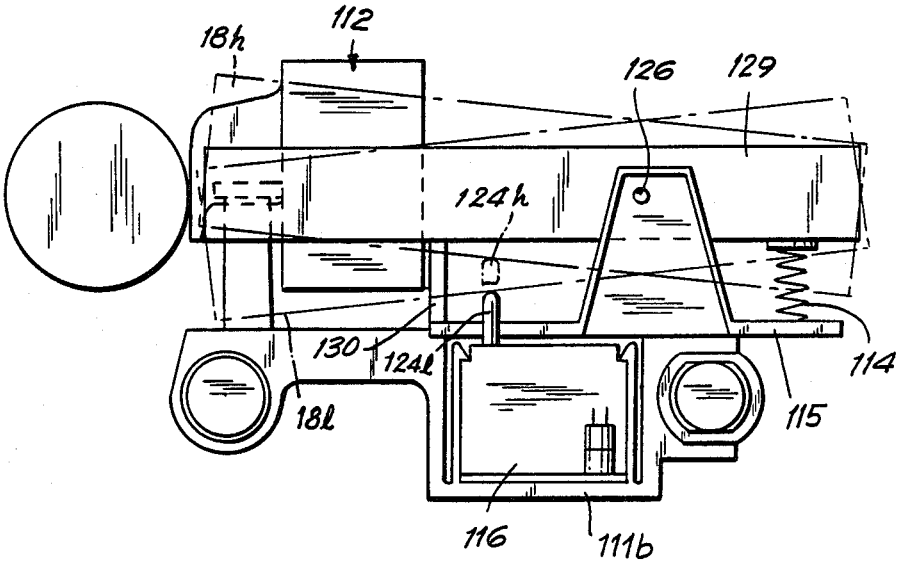
FIG. 20 is a side elevational view, in partial cross-section, of the embodiment of FIG. 16, showing the apparatus in position for monochrome printing in solid lines and in other positions for color printing in dashed lines.

FIG. 20 depicts, in solid lines, the positioning of a monochrome ink ribbon cartridge 129 in carriage 115. Monochrome ink ribbon cartridge 129 is mounted therein in the same way as multi-color ink ribbon cartridge 13. However, cartridge 129 does not have the downward opening groove 118 with which the multi-color cartridge of FIG. 16 is provided. Therefore, monochrome cartridge 129 can pivot about its axis in holes 126 of carriage of 115 under the influence of biasing spring 114 only so far as contact of the upper end of positioning member 130 on its bottom surface will allow. FIG. 20 also illustrates, in dashed lines, the low and high positions 18*l* and 18*h* which can be attained by a multi-color ink ribbon cartridge as cam follower rod 124 is moved between positions 124*l* and 124*h*, respectively. Note that monochrome ink ribbon cartridge 129 is not as thick as multi-color ink cartridge 18, so that its lower surface does not come into contact with cam follower rod 124, regardless of the position of rod 124. Monochrome cartridge 129 therefore remains in one position. Thus, the embodiment of FIGS. 16–21 does not require a detector for determining whether monochrome or multi-color printing is to be carried out.

Figure 21:
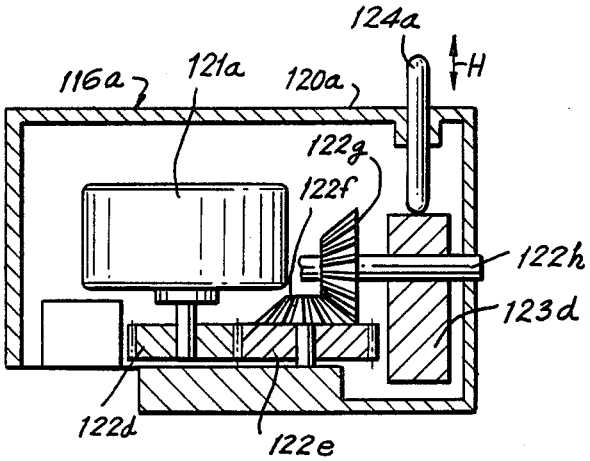
FIG. 21 is a cross-sectional elevational view showing the construction of an alternative motor unit to that of FIG. 16.

FIG. 21 depicts a motor drive unit 116*a* which can be used in the apparatus of FIG. 16 in place of motor drive unit 116. In this unit, a drive motor 121*a* is supported in housing 120*a*. A drive gear 122*d* is supported for driving on the motor shaft and is meshed with a round gear portion 122*e* of a double gear which is pivotably supported on housing 120*a*. A beveled portion 122*f* of the double gear meshes, in turn, with a beveled gear 122*g* which is connected to and rotates on shaft 122*h*. Shaft 122*h* is supported on housing 120*a* and supports and rotates a cam 123*d* which drives cam follower rod 124*a* up or down as indicated by arrow H. Cam 123*d* is an eccentrically mounted disk. As was the case with the drive on the periphery of cam 123*d* of FIG. 17, the up or down motion of cam follower rod 124*a* of FIG. 21, moves the multi-color ink ribbon cartridge up and down for the selection of a color ribbon band for printing by print head 112.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer adaptable for printing in monochrome or multi-color ink, the printer comprising:

a printer body;

ink ribbon cartridge holder means supported on the printer body for removably receiving a monochrome or a multi-color ink ribbon cartridge;

transmission means supported on the printer body coupled to the cartridge holder means for positioning a cartridge held in the cartridge holder means for printing;

drive means selectively mountable on the printer, selectively engageable with the transmission means, for supplying power to the transmission means to selectively position the cartridge holder means in response to a first control signal;

the transmission means positioning the cartridge holder means for monochrome printing when the drive means is not present, and, when the drive means is present, for one of monochrome and color printing;

adjustable control signal means for providing the first control signal; and setting means including a semi-fixed resistor, the adjustable control signal means adjusted by the setting means.

2. The printer of claim 1 wherein the output of the semi-fixed resistor is an analog voltage and further comprising:

means for converting the analog voltage into a digital signal;

register means having the digital signal as an input; and means for comparing the digital signal in the register means with a drive input signal to provide a signal for driving the driving means.

3. A printer adaptable for printing in monochrome or multi-color ink, the printer comprising:

carriage means;

ink ribbon cartridge holder means for removably receiving a monochrome or a multi-color ink ribbon cartridge, one of which having a identifying structural characteristic including a first projection that structurally distinguishes it from the other type of cartridge;

detector means for providing a first control signal in response to the presence or absence of the structural characteristic;

transmission means mounted on the carriage means and coupled to the cartridge holder means for positioning a cartridge held in the cartridge holder means for printing, the transmission means responsive to the first control signal to correctly position the cartridge holder means for one of monochrome and multi-color printing;

print head means mounted on the cartridge means, the cartridge holder means being rotated by the transmission means relative to the print head means;

the carriage means having a second projection and the detector means being further responsive to the second projection to provide a second control signal, the transmission means further responsive to the second control signal to position the cartridge holder means at a home color position; and the detector means including a single circuit switch including two sets of contacts, a first set being normally closed and a second set being normally open, the first set of contacts being opened by contact with the first projection and the second set of contacts being closed when the cartridge holder means has been positioned at the home color position.

* * * * *